US005899198A

United States Patent [19]

Bradenbaugh

[11] Patent Number: 5,899,198

[45] Date of Patent: May 4, 1999

[54] SELF CLAMPING TEMPORARY FOAM DAM FOR PROTECTING WATER HEATER ELECTRICAL COMPONENTS

[75] Inventor: Kenneth Bradenbaugh, Weddington, N.C.

[73] Assignee: Prescotech Industries, Inc., Louisville, Ky.

[21] Appl. No.: 08/756,974

[22] Filed: Nov. 26, 1996

Related U.S. Application Data

[60] Provisional application No. 60/007,790, Nov. 30, 1995, abandoned.

[51] Int. Cl.[6] ..... F24H 1/00

[52] U.S. Cl. ..... 126/361; 126/344; 126/373; 122/494; 122/13.1; 220/444

[58] Field of Search ..... 126/361, 344, 126/373; 122/494, 13.1; 220/444

[56] References Cited

U.S. PATENT DOCUMENTS 5,263,469 11/1993 Hickman ..... 126/344
5,293,844 3/1994 Threatt ..... 126/373

*Primary Examiner*—Larry Jones
*Attorney, Agent, or Firm*—Wheat Camoriano Smith & Beres PLC

[57] ABSTRACT

A removable dam provides a way to prevent liquid insulation from interfering with electrical components and from squirting out an opening in the jacket of a hot water heater.

6 Claims, 1 Drawing Sheet

SELF CLAMPING TEMPORARY FOAM DAM FOR PROTECTING WATER HEATER ELECTRICAL COMPONENTS

This application claims priority from U.S. Provisional patent application Ser. No. 60/007,790, filed Nov. 30, 1995, now abandoned.

This invention relates to water heaters having foam insulation injected between a cylindrical water tank and an outer jacket. Particularly, the invention relates to water heaters having an opening in the outer jacket, providing access to electrical or other components located between the tank and the outer jacket.

It is known to provide dams surrounding electrical components and extending between the tank and the outer jacket for protecting the components from insulating foam injected between the tank and the outer jacket. Such dams, made of resilient materials such as fiber glass, prevent the injected foam from covering the electrical components and from flowing out the opening in the outer jacket. The dams become permanent fixtures of the water heaters as the injected foam bonds to them as the foam solidifies.

SUMMARY OF THE INVENTION

According to the present invention, improved dams for protecting electrical and other components, and methods for using such dams are disclosed.

DESCRIPTION OF THE PREFERRED EMBODIMENT

Figure 1:
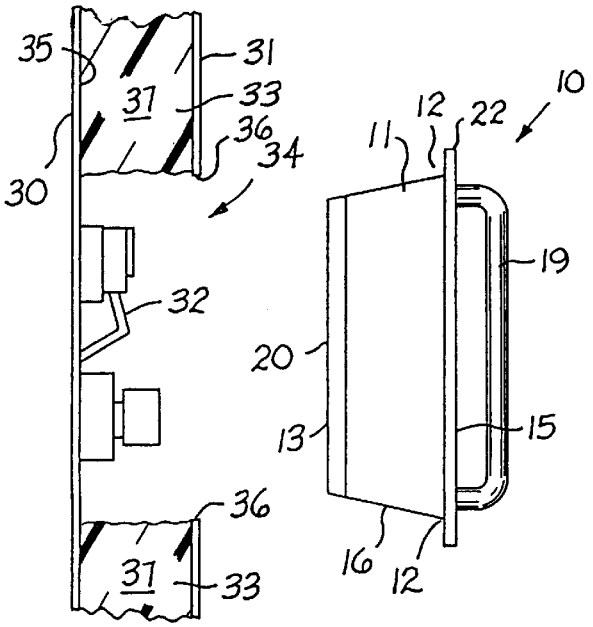
FIG. 1 is a partial cross section of a hot water heater, showing a water tank 30, an outer shell 31, electrical components 32, and a dam 10, made in accordance with the present invention, which is about to be inserted into an opening of the hot water heater.

FIGS. 1 through 4 show a dam 10 for temporary installation in an opening 34 in the outer jacket 31 of a water heater during the time the insulating foam 37 is injected. The dam 10 is then removed from the opening 34 after the foam 37 has set and ceased to expand.

The dam 10 comprises a plug 11 having an outer peripheral edge 12, an inner end 13 and a depth, from the outer edge 12 to the inner end 13. The depth of the plug 11 is at least as great as the distance between the tank wall 35 and the jacket wall 31, so the plug 11 can fill that space. Plug 11 also has an opening 14 extending therethrough from the inner surface 13 through the outer surface 15.

In use, plug 11 is placed into the opening 34 in the outer jacket 31, with the outer edge 12 of the plug 11 in contact with the shell edge 36 at the opening 34 and the inner surface 13 in contact with the wall 35 of the water tank 30. The outer edge 12 and inner surface 13 of the plug 11 are sealing surfaces, such that fluid foam 37, injected into the space 33 between the water tank 30 and the outer jacket 31, will not flow between the outer edge 12 and the edge 36 of the opening in the outer jacket 31 or between inner surface 13 and the water tank 30, and will not flow into the area of the electrical components 32. Electrical components 32, attached to the water tank 30, fit within the opening 14 in the plug 11. After the foam 37 has been injected into the space 33 between the outer jacket 31 and the water tank 30, has ceased to flow, and has set, the dam 10 is removed from the opening in the outer jacket 31.

The plug 11 may be made with an outer surface 16 of a material such as Teflon™, which will not stick to the fluid foam 37 injected into the space 33 between the outer jacket 31 and the wall 35 of the water tank 30.

Figure 5:
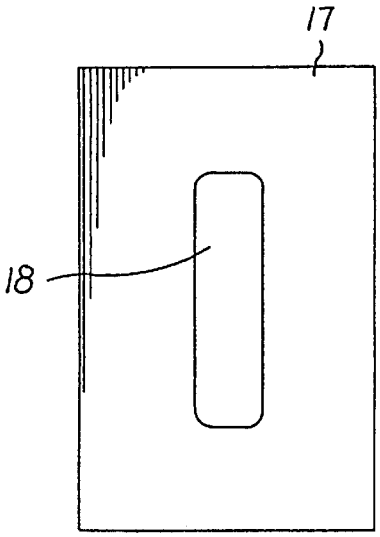
FIG. 5 is a view of a sheet 17 of flexible material.
Figure 2:
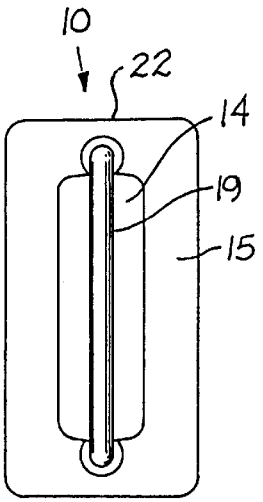
FIG. 2 is a front view of the dam 10 of FIG. 1.

Alternatively, a thin, flexible sheet 17 shown in FIG. 5, made of material such as polyethylene film, other plastic film, paper or the like, having an opening 18, may be placed over the plug 11 such that sheet opening 18 is in alignment with the plug opening 14 and the sheet 17 may be wrapped around the plug 11 to cover the plug 11 from the inner surface 13 to the outer edge 12. The plug 11, with wrapping sheet 17, is placed in the outer jacket opening 34 with the inner surface 13, (covered by sheet 17), contacting the water tank wall 35, and the outer edge 12, (covered by sheet 17), contacting the edge 36 of the outer jacket 31 at the opening 34. Fluid foam 37, injected into the space 33 between the outer jacket 31 and the water tank wall 35 contacts the sheet 17. When the foam 37 ceases to flow and sets, the plug 11 is removed from the opening 34 in the outer jacket 31. The sheet 17, in contact with the foam 37, remains in the space 33 between the outer jacket 31 and the water tank 30 wall 35.

A handle 19, attached to the plug 11, is provided for inserting and removing the plug 11 from the opening 34 in the outer jacket 31.

The inner surface 20 of the plug 11 may be made of a compressible material, such as foam rubber, resilient polyurethane foam and the like, which, when brought into contact with the water tank wall 35, will deform to obtain leak tight contact with the water tank wall 35 in order to seal against the wall 35.

Figure 4:
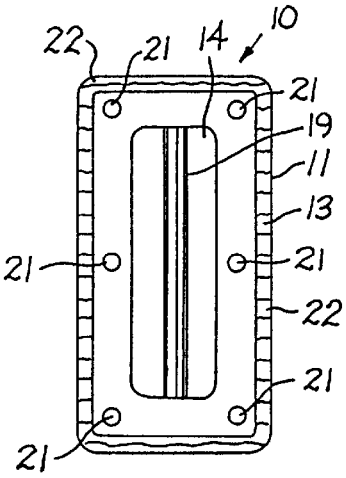
FIG. 4 is a rear view of the dam 10 of FIG. 1.

The plug 11 is held in place within the outer jacket opening 34 by some type of holding means. The holding means may be a friction fit between the outer edge 12 of the dam 10 and the edge 36 of the outer jacket 31. The holding means may alternatively be a mechanical latch, a magnetic attraction between the dam 10 and the water heater, or be another suitable means. FIG. 4 shows magnets 21 inset into the inner surface 13 for holding the plug 11 in contact with the water tank wall 35 by magnetic attraction.

FIGS. 1 through 4 also show an outer magnet 22, attached to the periphery of the plug 11, surrounding the outer edge 12 of the plug, serving as a lip which holds the plug 11 in contact with the outer jacket 31.

Upon inserting the plug 11 into the outer jacket opening 34, inner magnets 21 hold the plug inner surface 13 in contact with the water tank wall 35, and outer magnet 22 holds the plug 11 in contact with the outer jacket 31.

Figure 3:
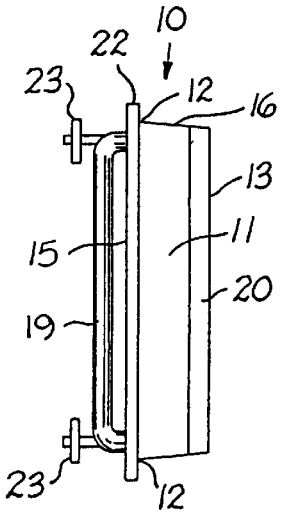
FIG. 3 is a side view of the dam 10 of FIG. 1.

A plunger mechanism 23, shown in FIG. 3, may extend from the plug inner surface 13 through the plug outer surface 15 for aiding in release of the dam 10 from the outer jacket opening 34. The plunger 23 is a hydraulically-actuated or spring-actuated device, which, when depressed, pushes against the wall 35 of the tank 30 to remove the dam 10 from the water heater.

Thus, by employing the dam 10 of the present invention in the outer jacket opening 34, the electrical components 32 attached to the wall 35 of the hot water tank 30 are protected from fluid insulating foam 37, and the fluid insulating foam 37 is contained in the space 33 between the water tank 30 and the outer jacket 31. Upon the insulating foam 37 setting and ceasing to flow, the dam 10 can be removed for use in another water heater.

What is claimed is:

1. A water heater and removable dam combination, comprising:

a water heater tank;

a jacket surrounding said tank, spaced a distance from said tank, and defining an opening;

electrical components mounted on said tank in the area of the opening; and a removable dam means including a sealing surface about the same size as the opening and sized to fit through the opening in the jacket and to seal off the distance between the tank and the jacket around the electrical components so that, when liquid foam is inserted into the space between the tank and jacket, it will be prevented by the dam means from interfering with the electrical components and will be prevented by the dam means from squirting out the opening in the jacket.

2. A water heater and removable dam combination, comprising:

a water heater tank;

a jacket surrounding said tank, spaced a distance from said tank, and defining an opening;

electrical components mounted on said tank in the area of the opening; and a removable dam sized to fit through the opening in the jacket and to seal off the distance between the tank and the jacket around the electrical components so that, when liquid foam is inserted into the space between the tank and jacket, it will be prevented by the dam from interfering with the electrical components and will be prevented by the dam from squirting out the opening in the jacket, wherein one of said tank and said dam includes a magnet which provides a magnetic attraction between the dam and the water heater.

3. A water heater and removable dam combination as recited in claim 2, wherein the magnet is mounted on the removable dam.

4. A water heater and removable dam combination, comprising:

a water heater tank;

a jacket surrounding said tank, spaced a distance from said tank, and defining an opening;

electrical components mounted on said tank in the area of the opening; and a removable dam sized to fit through the opening in the jacket and to seal off the distance between the tank and the jacket around the electrical components so that, when liquid foam is inserted into the space between the tank and jacket, it will be prevented by the dam from interfering with the electrical components and will be prevented by the dam from squirting out the opening in the jacket, and further comprising a sheet wrapped around the dam.

5. A water heater and removable dam combination, comprising:

a water heater tank;

a jacket surrounding said tank, spaced a distance from said tank, and defining an opening;

electrical components mounted on said tank in the area of the opening;

a removable dam having a sealing surface, said removable dam being about the same size as the opening and sized to fit through the opening in the jacket and to seal off the distance between the tank and the jacket around the electrical components so that, when liquid foam is inserted into the space between the tank and jacket, it will be prevented by the dam from interfering with the electrical components and will be prevented by the dam from squirting out the opening in the jacket and so that, after the liquid foam has set, the entire removable dam including its sealing surface may be removed; and a holding means for holding the dam in position in the space between the tank and jacket.

6. A water heater and removable dam combination, comprising:

a water heater tank;

a jacket surrounding said tank, spaced a distance from said tank, and defining an opening;

electrical components mounted on said tank in the area of the opening;

a removable dam sized to fit through the opening in the jacket and to seal off the distance between the tank and the jacket around the electrical components so that, when liquid foam is inserted into the space between the tank and jacket, it will be prevented by the dam from interfering with the electrical components and will be prevented by the dam from squirting out the opening in the jacket; and a holding means for holding the dam in position in the space between the tank and jacket, and further comprising a sheet wrapped around the dam.

* * * * *